US009427083B2

(12) United States Patent
Dame et al.

(10) Patent No.: US 9,427,083 B2
(45) Date of Patent: Aug. 30, 2016

(54) FURNITURE DOCKING SYSTEM

(71) Applicant: HERMAN MILLER, INC., Zeeland, MI (US)

(72) Inventors: Paul Dame, Zeeland, MI (US); Michael J. Katje, Grand Haven, MI (US); Sheryl Knoll, Zeeland, MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 14/096,284

(22) Filed: Dec. 4, 2013

(65) Prior Publication Data

US 2014/0182229 A1 Jul. 3, 2014

Related U.S. Application Data

(60) Provisional application No. 61/734,253, filed on Dec. 6, 2012.

(51) Int. Cl.
*E04B 2/00* (2006.01)
*A47B 83/00* (2006.01)
*E04H 1/12* (2006.01)

(52) U.S. Cl.
CPC ..... *A47B 83/001* (2013.01); *E04H 1/125* (2013.01)

(58) Field of Classification Search
CPC ..... A47B 83/001; E04H 1/125
USPC ..... 52/582.1, 239, 284, 481.2
See application file for complete search history.

(56) References Cited

U.S. PATENT DOCUMENTS 4,224,769 A 9/1980 Ball et al.
4,619,486 A * 10/1986 Hannah et al. ..... 312/195
4,831,791 A * 5/1989 Ball ..... 52/36.1
5,209,035 A * 5/1993 Hodges et al. ..... 52/220.7
5,309,686 A * 5/1994 Underwood et al. ..... 52/29
5,341,615 A * 8/1994 Hodges et al. ..... 52/220.7
6,009,676 A * 1/2000 Feldpausch et al. ..... 52/239
6,044,612 A * 4/2000 Shipman et al. ..... 52/714
6,079,173 A * 6/2000 Waalkes et al. ..... 52/239
6,128,877 A * 10/2000 Goodman et al. ..... 52/242
6,173,545 B1 * 1/2001 Feldpausch et al. ..... 52/239
D446,028 S * 8/2001 Ruedinger et al. ..... D6/332
6,282,854 B1 * 9/2001 Vos et al. ..... 52/239
6,330,773 B1 * 12/2001 MacDonald et al. ..... 52/239
6,349,516 B1 * 2/2002 Powell et al. ..... 52/239
6,425,153 B1 7/2002 Reswick
6,442,909 B2 * 9/2002 Waalkes et al. ..... 52/239
6,536,858 B1 * 3/2003 Heidmann et al. ..... 312/245
6,883,277 B2 * 4/2005 Wiechecki et al. ..... 52/36.6

(Continued)

FOREIGN PATENT DOCUMENTS

WO WO 2009/052656 A1 4/2009

OTHER PUBLICATIONS

Unknown author, "Steelcase—c:scape solutions," Steelcase, Inc., © 2011, 20 pages.

*Primary Examiner* — Basil Katcheves

(74) *Attorney, Agent, or Firm* — Michael Best & Friedrich LLP

(57) ABSTRACT

A furniture docking system includes a dock and various dock supports, including freestanding and non-freestanding dock supports. The dock includes an upper rail having a primary channel and a pair of auxiliary channels opening upwardly from an upper surface of the upper rail, and a pair of side channels opening outwardly from opposite sides of the upper rail.

21 Claims, 19 Drawing Sheets

(56) References Cited

U.S. PATENT DOCUMENTS

| | | | | |
|---|---|---|---|---|
| 7,055,287 | B2 * | 6/2006 | Yu et al. | 52/220.7 |
| 7,357,086 | B2 * | 4/2008 | Petrick et al. | 108/50.02 |
| 7,921,615 | B2 * | 4/2011 | Picchio | 52/238.1 |
| 8,393,122 | B2 * | 3/2013 | Henriott et al. | 52/239 |
| 8,844,210 | B2 * | 9/2014 | Henriott | 52/36.5 |
| 2006/0278777 | A1 * | 12/2006 | Atkinson et al. | 248/188.4 |
| 2009/0293391 | A1 * | 12/2009 | DeVore | 52/239 |
| 2009/0293402 | A1 * | 12/2009 | Hamilton et al. | 52/481.2 |
| 2011/0298339 | A1 | 12/2011 | Udagawa et al. | |

* cited by examiner

FURNITURE DOCKING SYSTEM

This application claims benefit of U.S. Provisional No. 61/734,253, filed Dec. 6, 2012, the entire disclosure of which is incorporated herein by reference.

TECHNICAL FIELD

The present invention relates generally to a furniture docking system, and in particular to a dock configured and adapted to support various furniture components.

BACKGROUND

Various reconfigurable partition and workspace systems are well known. Typically, such systems define predetermined, fixed workspace footprints that are not variable, but rather are defined by the length of individual wall units incorporated into the system. As such, these types of systems are not easily reconfigurable to accommodate different, individual spatial and functional needs of the users. In addition, such systems are often closed or provide relative high barriers, which may inhibit collaboration and communication between adjacent co-workers.

In addition, conventional systems typically are one-sided, with storage, worksurfaces and/or other accessories mounted and/or made accessible from only one side of wall unit. As such, the systems make lack the ability to promote team building and collaboration across the wall.

SUMMARY

Briefly stated, in one aspect, one embodiment of a furniture docking system includes a plurality of docks each having opposite first and second sides and opposite first and second ends defining a length of each dock. The docks are arranged end-to-end along a longitudinal axis. Each of the docks includes an upper rail and a lower rail and a plurality of vertical frame members extending between and connecting the upper and lower rails. At least a first dock support and a second dock support are each releasably connectable to each of the docks in a plurality of longitudinally spaced locations along the length of the dock and include a floor engaging portion laterally spaced from the dock. The first dock support extends laterally from the dock on the first side thereof and the second dock support extends laterally from the dock on the second side thereof. The first dock support is releasably coupled to the upper rail and lower rail, while the second dock support is coupled to at least one of the upper rail, lower rail and/or one of the vertical frame members. A furniture accessory is to the upper rail and extends upwardly from the upper rail.

In another aspect, one embodiment of a dock includes an upper rail comprising an upwardly opening primary channel extending longitudinally along a centerline of a top of the upper rail, a pair of upwardly opening auxiliary channels extending longitudinally along a top of the upper rail on opposite sides of the primary channel, and a pair of side channels opening laterally outwardly from opposite sides of the upper rail. A first dock support is coupled to the upper rail at one of the auxiliary channels, and a second dock support is coupled to the upper rail at one of the side channels. A furniture accessory is coupled to the primary channel and extends upwardly from the upper rail.

In another aspect, one embodiment of a furniture docking system includes a freestanding dock support having laterally spaced inboard and outboard legs coupled to one of the docks at one of a plurality of positions along a length thereof, a foot support coupled to one of the docks at one of a plurality of positions along a length thereof, and extending laterally outwardly from at least one side thereof, and a non-freestanding dock support having at least one leg laterally spaced from the docks and coupled to one of the docks at one of a plurality of positions along a length thereof.

In yet another aspect, one embodiment of a furniture docking kit includes a dock having an upper rail, a freestanding dock support having inboard and outboard floor engaging supports, and a non-freestanding dock support having at least one outboard floor engaging support. The non-freestanding and freestanding dock supports are each connectable to the upper rail at a plurality of longitudinal positions spaced along a length of the upper rail, and may be connectable to the dock at a common longitudinal position.

The various aspects and embodiments provide significant advantages over other partition and workspace systems. For example and without limitation, the dock provides a central location for routing power and data while allowing for a large number of variations in configuring the system with storage, worksurfaces and other furniture accessories, which not only provide a unique work function, but may also serve a dual purpose of supporting the dock. The various dock supports can be quickly and easily reconfigured on the dock to accommodate the particular intended use, while maintaining adequate support for the dock.

The present embodiments of the invention, together with further objects and advantages, will be best understood by reference to the following detailed description taken in conjunction with the accompanying drawings.

DETAILED DESCRIPTION OF THE PRESENTLY PREFERRED EMBODIMENTS

The terms "longitudinal" and "axial" as used herein relates to a length or lengthwise direction, including for example a lengthwise direction of an upper or lower rail or a vertical frame member, notwithstanding that those directions are substantially perpendicular respectively. The term "lateral" and variations thereof refer to a sideways direction. The terms "top," "upper," "bottom" and "lower" are intended to indicate directions when viewing the dock and dock supports when positioned for use. It should be understood that the term "plurality," as used herein, means two or more. The term "coupled" means connected to or engaged with, whether directly or indirectly, for example with an intervening member, and does not require the engagement to be fixed or permanent, although it may be fixed or permanent. The term "transverse" means extending across an axis, including without limitation substantially perpendicular to an axis. It should be understood that the use of numerical terms "first," "second," "third," etc., as used herein does not refer to any particular sequence or order of components; for example "first" and "second" portions may refer to any sequence of such portions, and is not limited to the first and second portions of a particular configuration unless otherwise specified.

Dock

Figure 20:
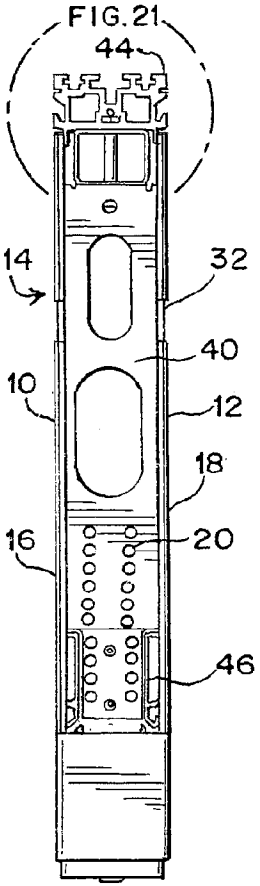
FIG. 20 is an end view of the dock shown in FIG. 19.
Figure 23:
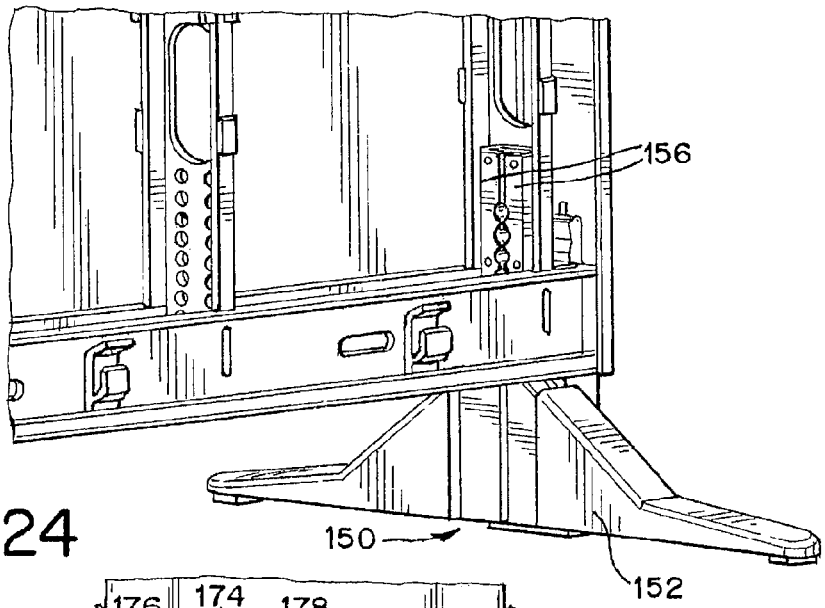
FIG. 23 is a partial perspective view showing a support foot coupled to a dock.
Figure 24:
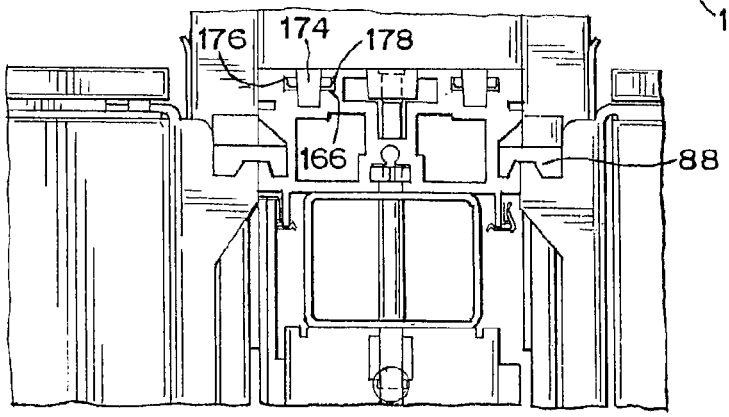
FIG. 24 is an enlarged partial end view showing one embodiment of a dock support connected to an upper rail.
Figure 25:
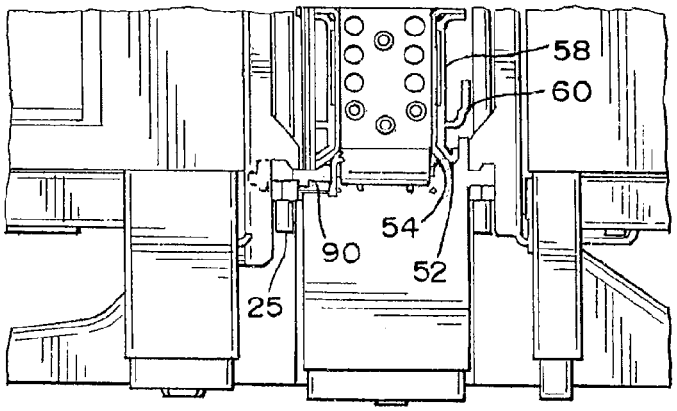
FIG. 25 is an enlarged partial end view showing the dock support of FIG. 24 connected to a lower rail.
Figure 26:
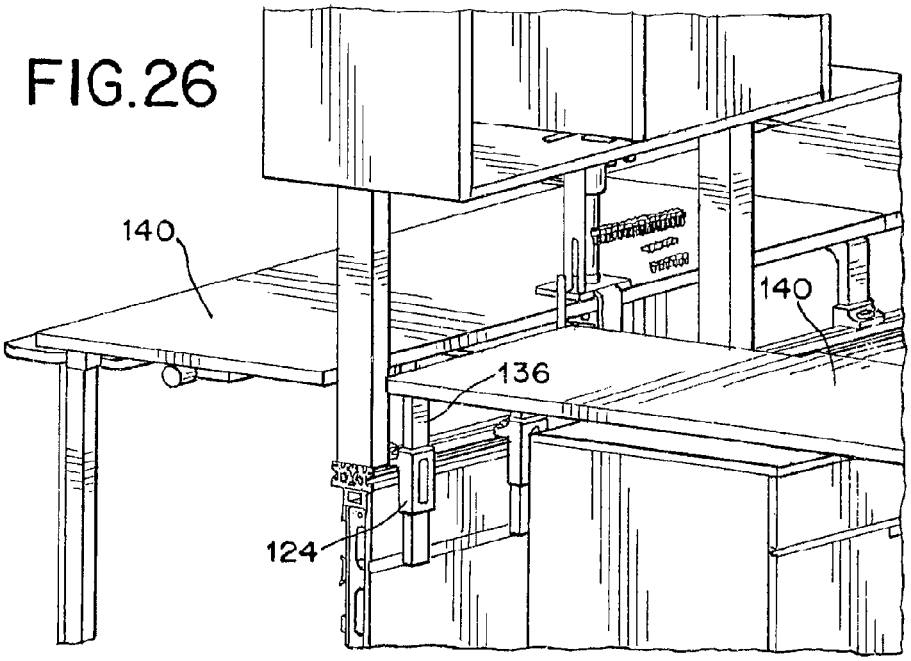
FIG. 26 is a partial perspective view showing first and second dock supports connected to a dock, together with a furniture accessory connected to the dock.
Figure 27:
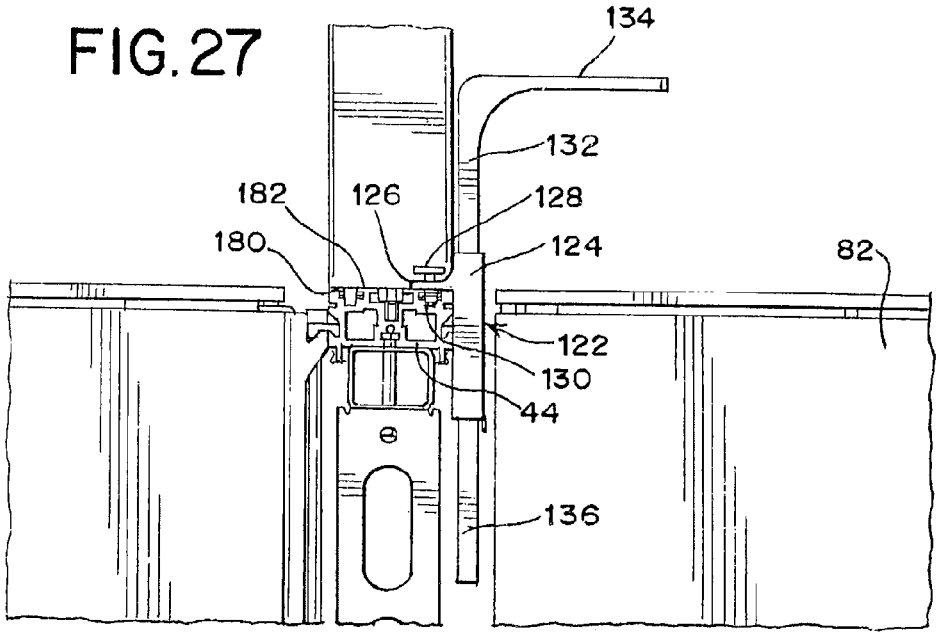
FIG. 27 is an end view of the dock assembly shown in FIG. 26.
Figure 28:
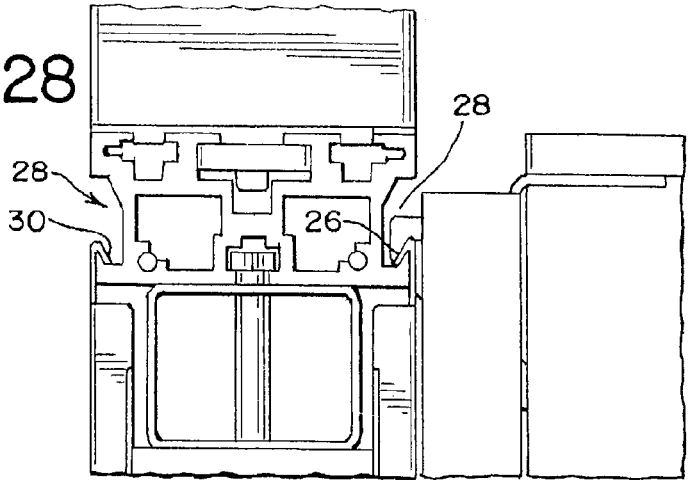
FIG. 28 is a partial end view of another embodiment of a dock support connected to an upper rail of a dock.
Figure 37:
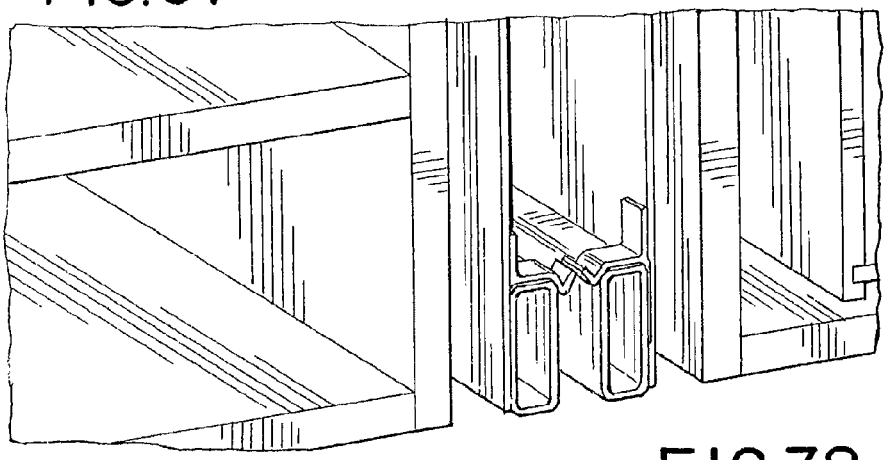
FIG. 37 is a section-cut view showing the coupling between a side panel and the bottom rail.

Referring to FIGS. 1-18, various embodiments of a dock system 2 are shown as including a plurality of docks 4 connected end-to-end to form a substantially linear dock assembly extending in a longitudinal direction 6. Each dock includes a wall component 14 having opposite first and second sides 10, 12 defining a width (W) of the dock. The first and second sides are defined by first and second side panels 16, 18 releasably coupled to an interior frame 20. For example, spring clips 22 positioned at the upper ends of the side panels may be biased into engagement with flanges 24 extending from the upper rail, with the lower portion of the side panel hooking on the bottom of the lower rail. Alternatively as shown in FIGS. 28 and 37, the side panels 16, 18 may be configured with hooks 26 that engage a lower edge of a side channel 28, which opens laterally outwardly and is configured with an inwardly and downwardly extending draw surface 30, with a bottom portion of the side panel having a spring clip that engages the top of the lower rail. The side panels 16, 18 may have a pass through channel 32 (see FIG. 20) formed intermediate upper and lower ends, or the channel may be omitted in some embodiments. Each dock 4 also includes opposite first and second ends 34, 36, with a length (L) of the dock defined between the first and second ends spaced along the longitudinal direction 6.

In one embodiment, the interior frame 20 includes a plurality of longitudinally spaced vertical frame members 40, formed in one embodiment with a C-shaped cross-section. One or more through openings 42A, B is vertically spaced, and longitudinally aligned, to provide a pass through opening for data and electrical lines. Each dock further includes an upper and lower rail 44, 46 secured to opposite ends of the vertical frame members. A pair of longitudinally spaced support feet 48, having a width less than or equal to W, are secured to opposite ends of the lower rail 46 or an endmost one of the vertical frame members 40 and are dimensioned to elevate the lower rail 46 a predetermined vertical distance $H_{lr}$ from the floor, such that an open space 48 is formed beneath the wall component.

In one embodiment, the lower rail 46 is configured as a pair of spaced apart and outwardly opening C-shaped channels 50. A lower flange 52 of each channel provides an outwardly and downwardly tapered clamping surface 54. A plurality of cable brackets 58 may be inserted between the upper and lower flanges of each side of the rail. Each bracket includes an upwardly opening clip 60 that may support and grasp various cables and cords.

Figure 29:
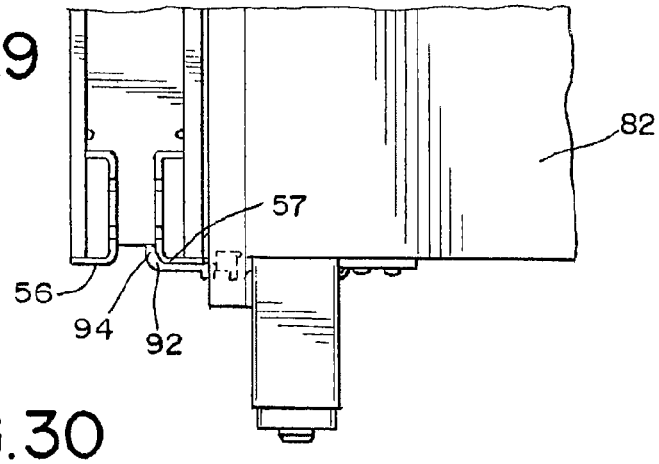
FIG. 29 is a partial end view of the dock support in FIG. 28 connected to a lower rail of a dock.
Figure 30:
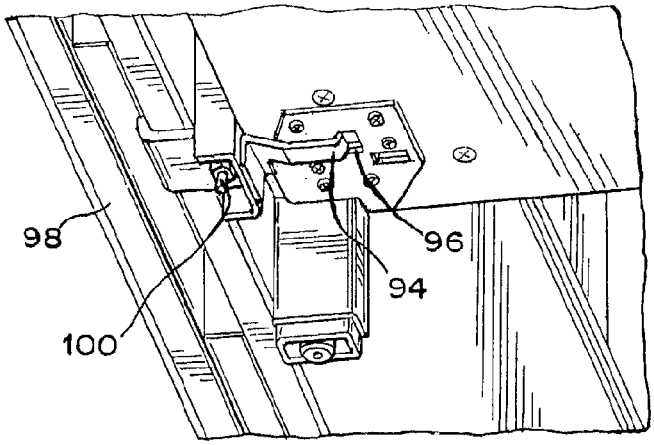
FIG. 30 is a bottom perspective view of the connection between the dock support and lower rail shown in FIG. 29.

In an alternative embodiment as shown in FIG. 29, the lower rail is configured as a pair of spaced apart rectangular tube members 56, which define a bottom surface 57. It should be understood that in other embodiments, the lower rail could be formed as a single integral member, and may assume various shapes, e.g., through extrusion or by bending and other forming operations.

In one embodiment, the upper rail includes an upwardly opening primary channel 62 extending longitudinally along a centerline 64 of the top of the rail, and a pair of upwardly opening auxiliary channels 66 extending longitudinally along the top of the upper rail on opposite sides of the primary rail. In one embodiment, all three channels have a T-shape or opening upwardly through the top of the rail. The upper rail is supported by a rectangular tubular frame member 68 extending longitudinally along a length of the dock, with the tube member being secured to the vertical frame members. The upper rail includes a downwardly opening T-shaped channel 70, shaped to receive the heads 72 of a plurality of bolts or other fasteners such as a nut, which secure the upper rail 44 to the frame 68, and further to the vertical frame members 40 in one embodiment. The upper rail 44 further includes a pair of side channels 28 opening laterally outwardly from opposite sides of the upper rail, as discussed previously.

Dock Supports

Referring to FIGS. 1-18, the dock 4 is maintained in a vertical orientation by a plurality of dock supports, which may take various forms and be coupled to the dock in different places. The dock supports may support the dock individually, or in combination. Various dock supports may be secured to the upper rail 44 only, the lower rail 46 only, the vertical frame members 40, or various combinations thereof.

Freestanding Dock Supports

Referring to FIGS. 1, 2, 14-18, 24, 25 and 28-30, the first type of dock support is a freestanding dock support 80, meaning the dock support is configured to not only support the dock, but also is self supporting, meaning it has the same orientation when secured to the dock, and when unsecured, or freestanding. In one embodiment, a freestanding dock support is configured as a low storage unit 82, e.g., a cabinet, which may be configured with an interior storage space. The interior may be open, and partitioned with shelves, or may include a door and/or drawers. In one embodiment, the low storage unit may include a plurality of legs or support members, shown as four, although a greater or lesser number may be suitable. In one embodiment, the free standing dock support includes laterally spaced inboard and outboard legs 86, regardless of whether it is arranged perpendicular or parallel to the dock 4. The dock support 80 may be secured to only one side of the dock (FIG. 2E), or both sides (FIG. 2F), and may assume a parallel or perpendicular relationship to the dock in either arrangement.

In one embodiment, the freestanding dock support 80 is releasably coupled to the dock 4, including to the upper and lower rails 44, 46. For example, a connector 84 may include upper and lower draw blocks 88, 90 engaging the side channel 28 of the upper rail and the bottom surface 54, 57 of the lower rail 46, whether the flange of a C-shaped channel 50, or the bottom of a tube member 56. In the latter embodiment, the draw block 90 is configured as a plate 92 with an upstanding flange 94 dimensioned to capture the tube member 56. The connector may further include a clip 94 that engages a catch opening 96 positioned on the bottom of the low storage. The connector may further include a C-shaped channel 98 which acts as an aesthetic sheath for a draw rod 100, which extends between the draw blocks 88, 90. The draw rod 100 is threadably engaged with one or both of the upper and lower draw blocks 88, 90, and draws the blocks together so as to clamp the dock support 80 to the dock 4. In this way, the dock 4 is securely coupled to the dock support 80, which in turn supports the dock.

Figure 31:
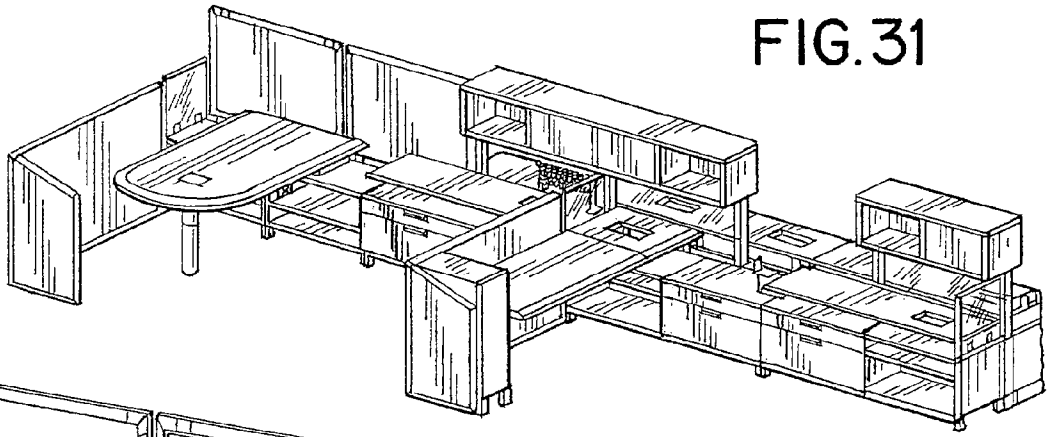
FIG. 31 is a perspective view of one embodiment of a dock system.
Figure 32:
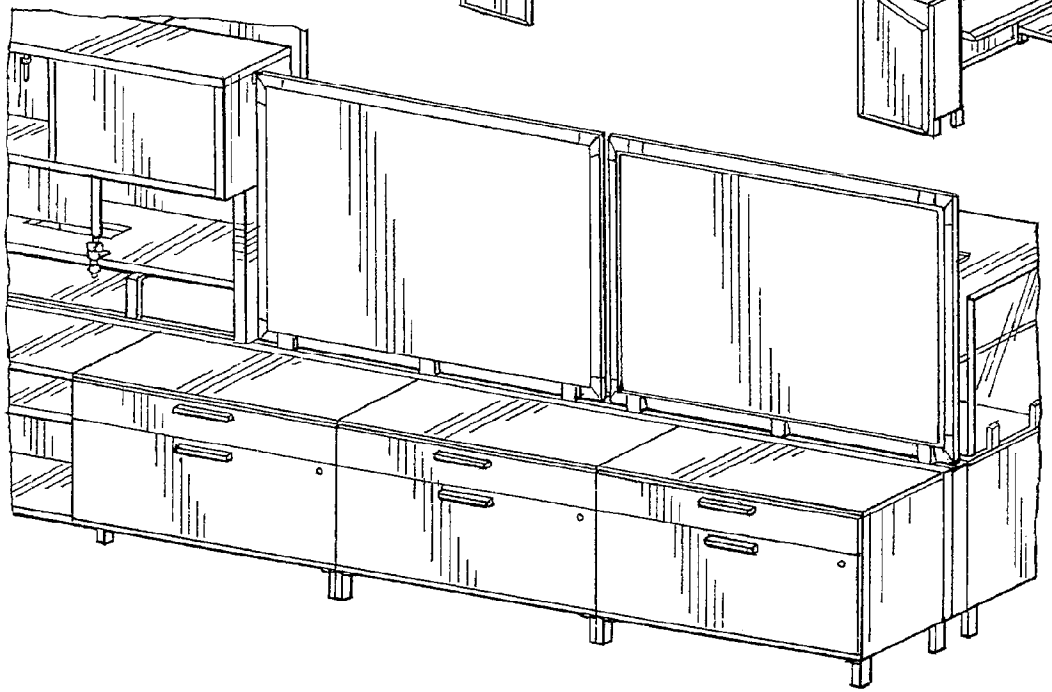
FIG. 32 is a perspective view of different screens and freestanding dock supports coupled to a dock.
Figure 35:
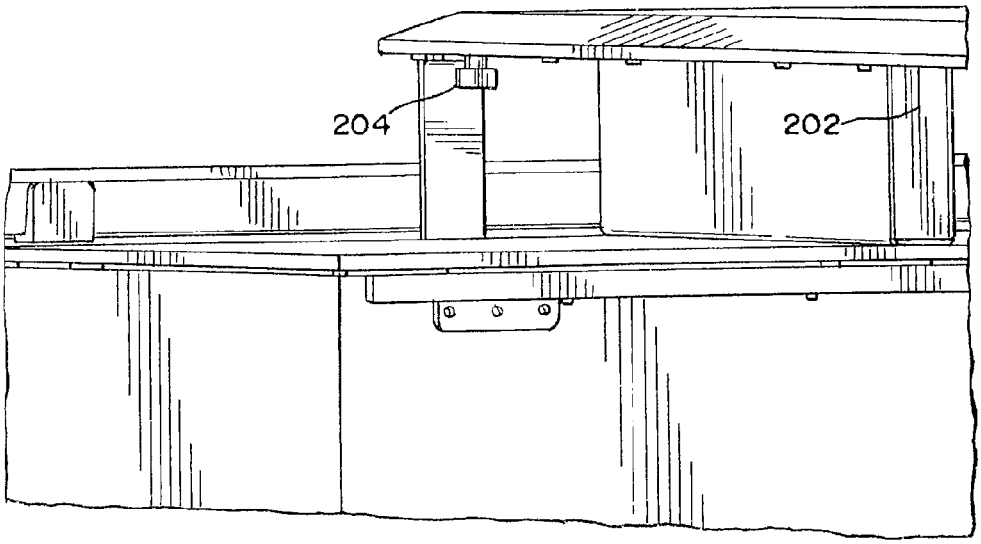
FIG. 35 is a partial perspective view showing a worksurface coupled to a freestanding dock support component.
Figure 36:
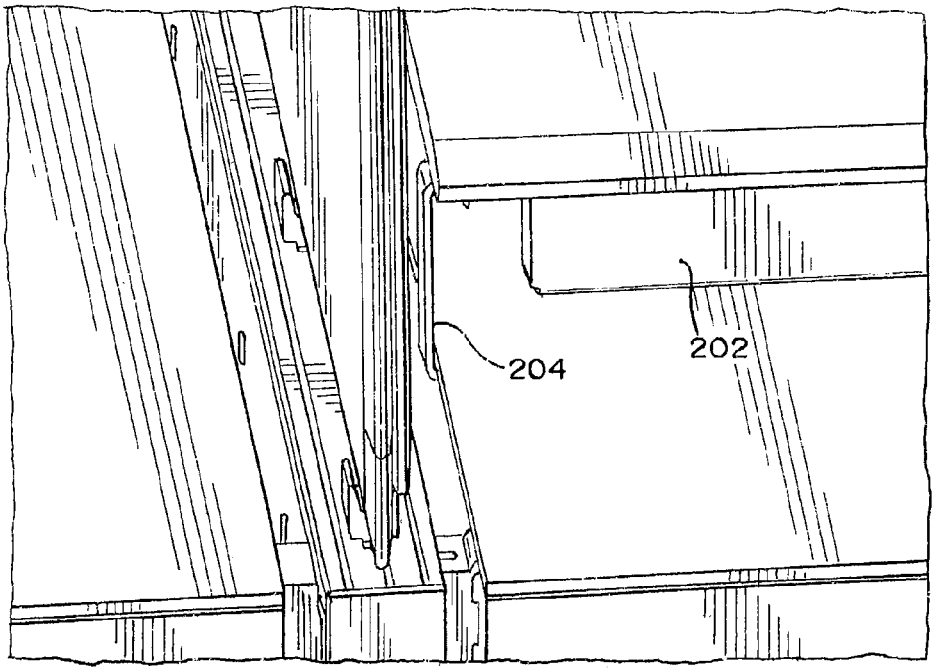
FIG. 36 is a partial perspective view showing a screen mounted to an upper rail and a worksurface mounted to a freestanding dock support component.

In one embodiment, shown in FIGS. 31, 35 and 36, a worksurface may overlie the top of the freestanding dock support, and be supported thereon by a stanchion 202. In one embodiment, the freestanding dock support has an outer or upper top supporting by a lower, inner top, with a gap formed therebetween as shown in FIGS. 35 and 36. An auxiliary stanchion 204 may have a flange portion slid into the gap and secured to the lower, inner top, with a vertical support extending upwardly to further support the worksurface.

Non-Freestanding Dock Supports

Figure 1:
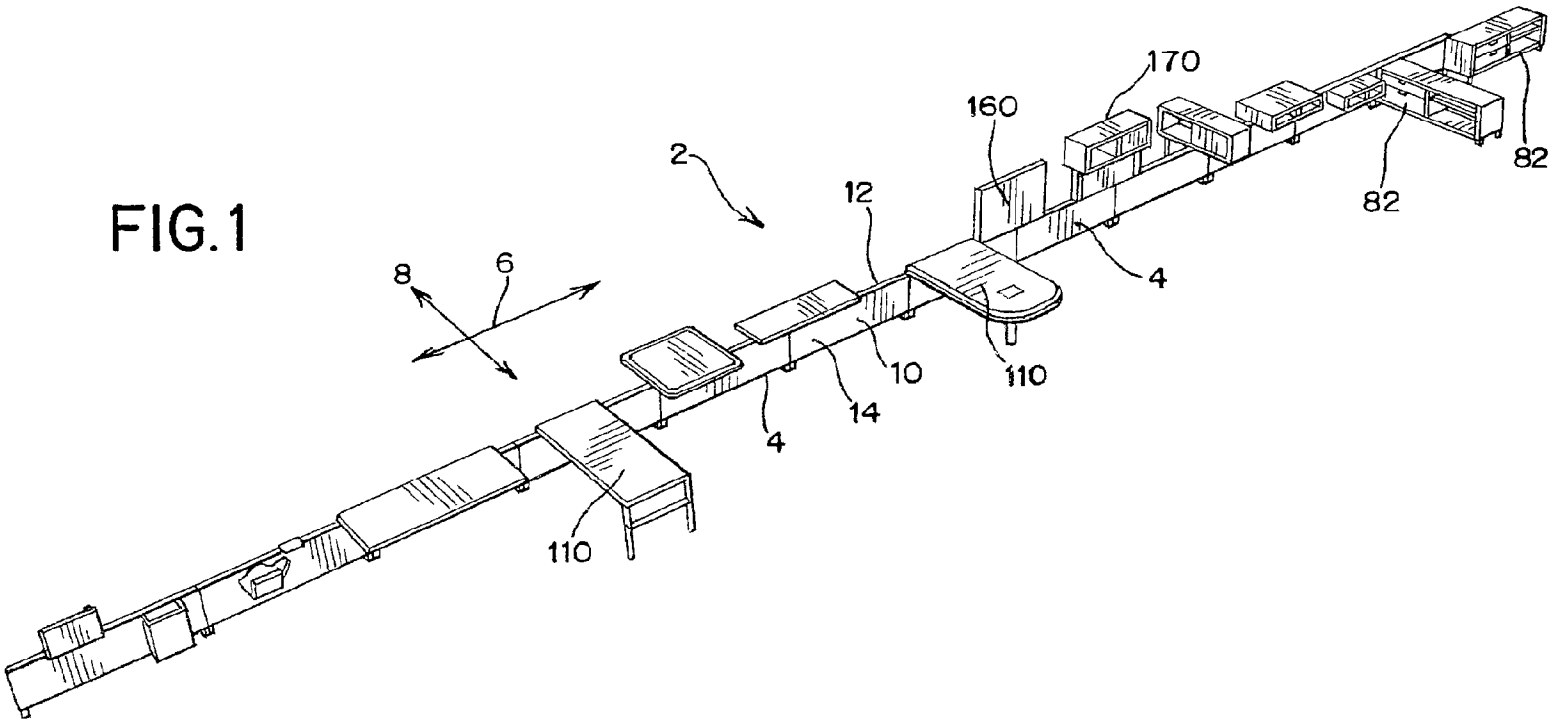
FIG. 1 is a perspective view of an exemplary embodiment of a furniture docking system.
Figure 2A:
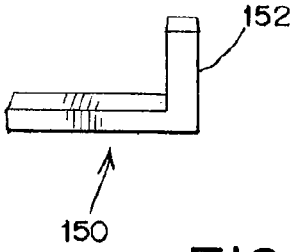
FIGS. 2A-F are perspective views of various dock supports.
Figure 2B:
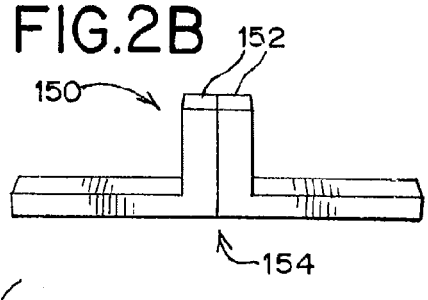
Figure 2D:
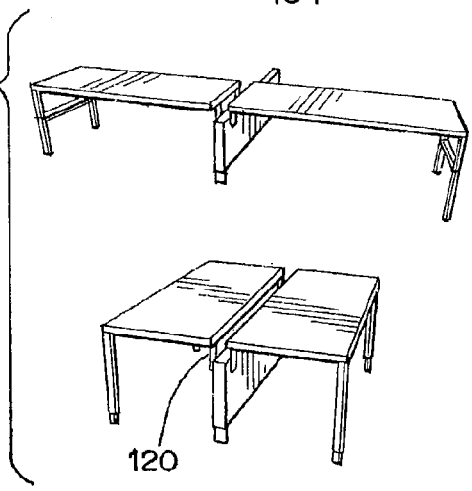
Figure 2C:
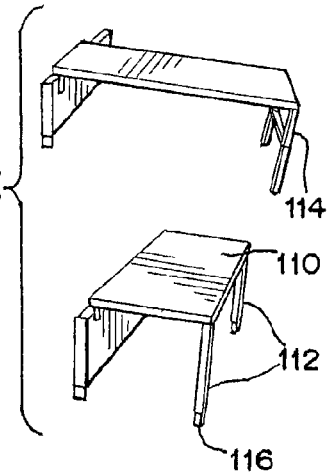
Figure 2E:
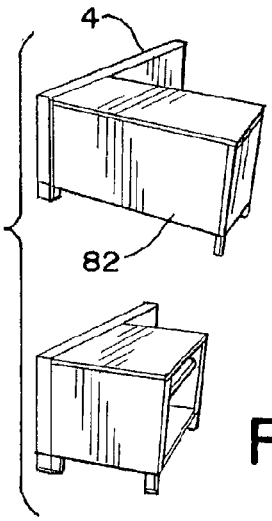
Figure 2F:
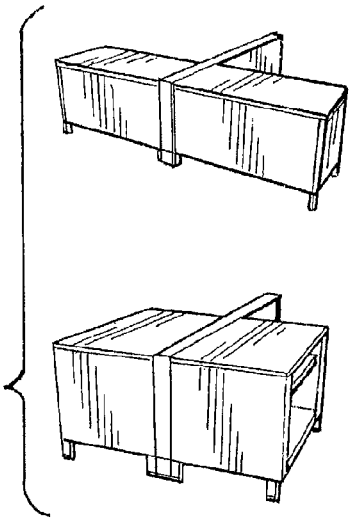

Referring to FIGS. 1-13, 26 and 27, a second type of dock support is a non-freestanding dock support, meaning the dock support is not self supporting, but rather relies on the dock for support, while supporting the dock in return. In this way, the dock and dock support work in combination to provide a stable structure and maintain the proper orientation of both components. The dock support may be secured to only one side of the dock (FIGS. 2A, C) or both sides thereof (FIGS. 2B, D).

In one embodiment, a non-freestanding dock support is configured as a desk 110 (FIGS. 2C, D) having only one or more supports 112, 114, shown as legs, positioned at one end of a worksurface, which is laterally spaced from the dock. The leg includes a floor-engaging portion 116, and is height adjustable. An opposite end of the worksurface is releasably coupled to the dock 4 with a connector or tether system 120.

In one embodiment, the connector 120, or tether system, includes a support 122 having a guide member 124 with a laterally extending flange 126. A fastener 128 extends through the flange and threadably engages a nut 130, or other fastener, disposed in the T-shaped auxiliary channel 66. The fastener may include a grippable member, allowing the fastener to be tightened and secure the guide member 124 to the upper rail 44. The guide member includes and defines a vertical channel extending along an outer surface of one the side panels 16, 18. An L-shaped support 132 is received in the channel and is vertically adjustable relative to the guide member 124. A releasable detent secures the support to the guide member. In other embodiments, a set screw or similar device may releasably couple the support and guide member. The opposite end of the worksurface is coupled to an upper horizontal leg 134 of the support that extends laterally outwardly from a vertical post 136, which slides within the channel of the guide 124. The height of the support 132 may be adjusted to accommodate different height worksurfaces 140, for example which may overlie a low storage dock support coupled to the dock therebeneath.

In various embodiments, the worksurface 140 may have a longitudinal axis running parallel or perpendicular to the dock. The non-freestanding dock supports may be connected along any portion of the upper rail, i.e., the dock support is infinitely adjustable, except at a location occupied by the freestanding connector, and may be positioned on opposite sides of the dock at the same or different locations, or along only one side thereof.

In addition to worksurfaces, various storage components and shelving may also be secured with the tether system.

Foot Supports

Referring to FIGS. 2, 3, 8-13, and 23, a third type of dock support is configured as a foot support 150. The foot support 150 may include a one-sided L-shaped foot 152, or a two-sided T-shaped foot 154, the latter being configured with two one-sided L-shaped foot supports 152 or integrally formed as a single unit. Each foot support includes an upstanding leg 156 that is secured to one of the interior vertical frame members 40, e.g., with one or more fasteners. The various foot supports may be alternatively used to counter loads on one or both sides of the dock. In one embodiment, a plurality of foot supports may support a dock 4 by themselves, or in combination with a free-standing or non-freestanding dock supports.

Up-Mounted Accessories

Figure 33:
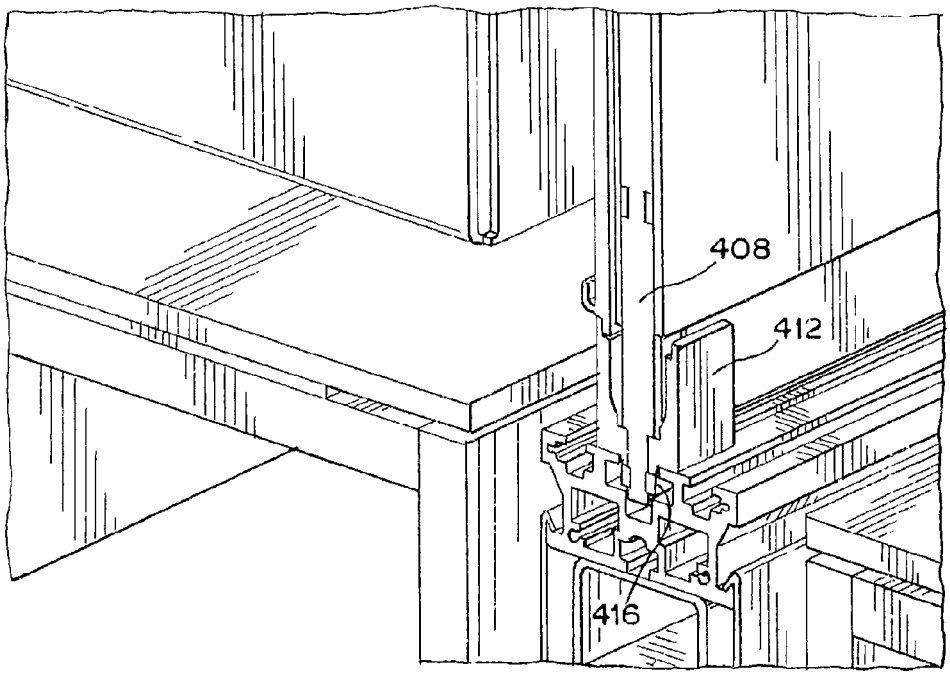
FIG. 33 is a section-cut view showing the coupling between a screen and an upper rail of the dock.
Figure 34:
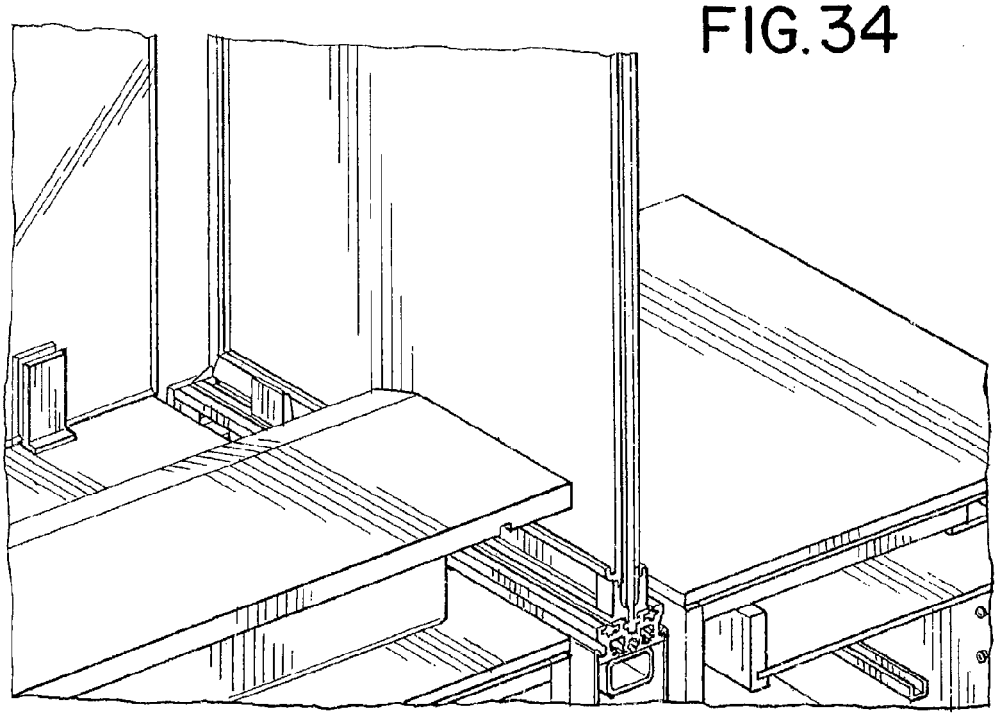
FIG. 34 is a section-cut view showing a screen coupled to an upper rail.

Referring to FIGS. 1, 3, 7, 9-13, 16-18, 24, 26 and 27, various up-mounted accessories may be secured to the upper rail of the dock. For example, a screen 160, shown in FIG. 3, may be disposed in the primary channel. As shown in FIGS. 33 and 34, the screen may include a plurality of stanchions 408 that are threadably engaged with nuts 410 in the primary channel of the upper rail of the dock. The stanchions, configured as rods, are inserted veritically into openings formed in the bottom of the screen. A plurality of brackets 412 each straddle opposite sides of the screen and supports the bottom of the screen, while being secured to the rail with the stanchion. The screen may be transparent or opaque, and may include a tackable and/or writable surface, e.g., white or black board.

Alternatively, high storage 170 may be configured with one or more stanchions 172 having a pair of downwardly extend tabs 174 or bolts that are received in the auxiliary channels 66 to stabilize the stanchion. If configured as a bolt, the tab 174 may engage nuts 176 disposed in the horizontal portion 178 of the channel 66. A nut 180 is disposed in the primary channel 62, with a fastener 182 extending from the stanchion 172 and threadably engaged with nuts to secure the stanchion to the upper rail. The bottom 180 of the stanchion engages the upper surface 182 of the upper rail, which supports the weight of the stanchion. Various components, such as storage components 184 are coupled to a pair of spaced apart stanchions 172. The stanchions are infinitely adjustable along the length of the dock, except the stanchions may not be co-located with the worksurface support or tether 124.

Assembly

Figures 3, 4, 5:
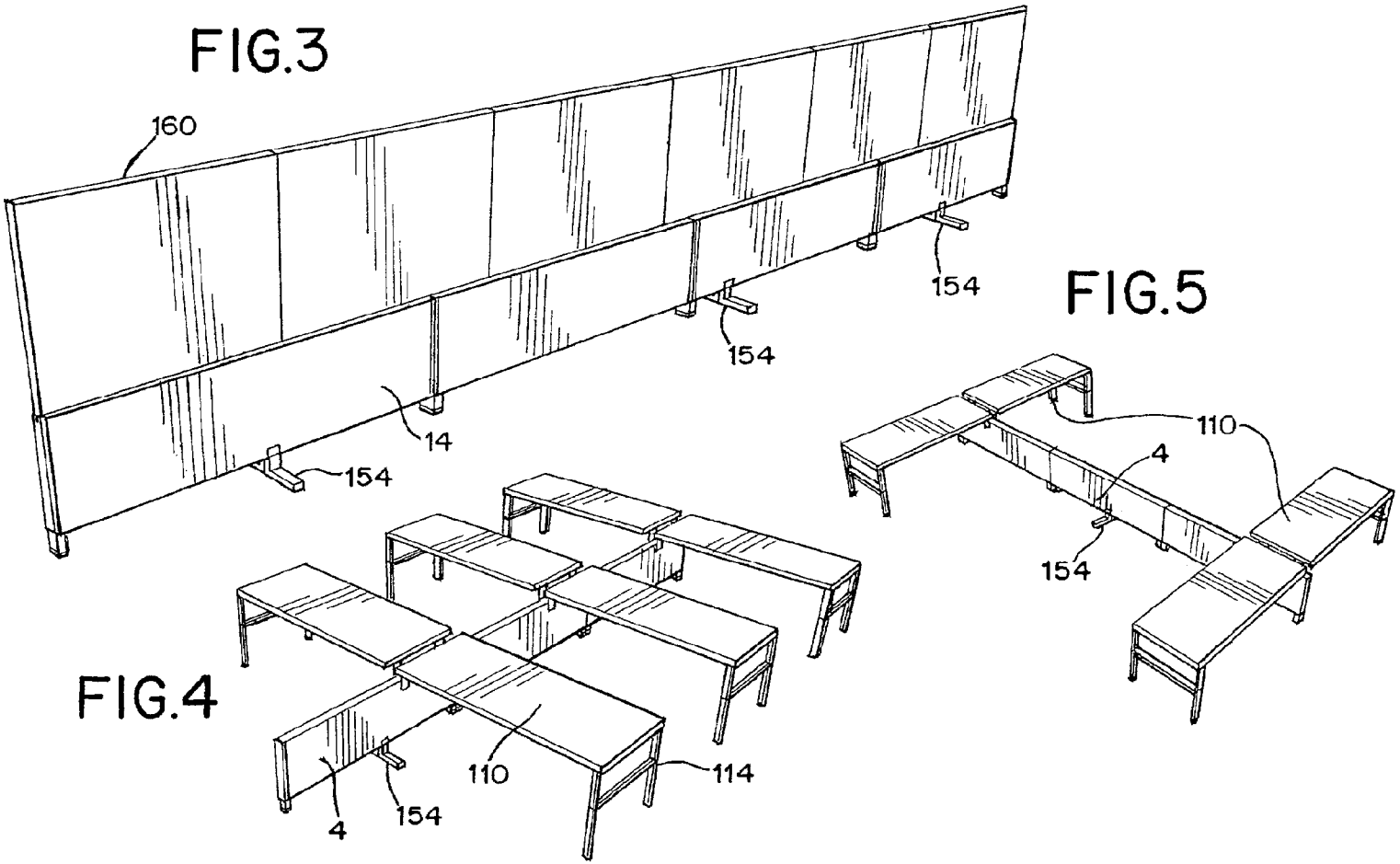
FIGS. 3-18 show various furniture docking system configurations
Figure 6:
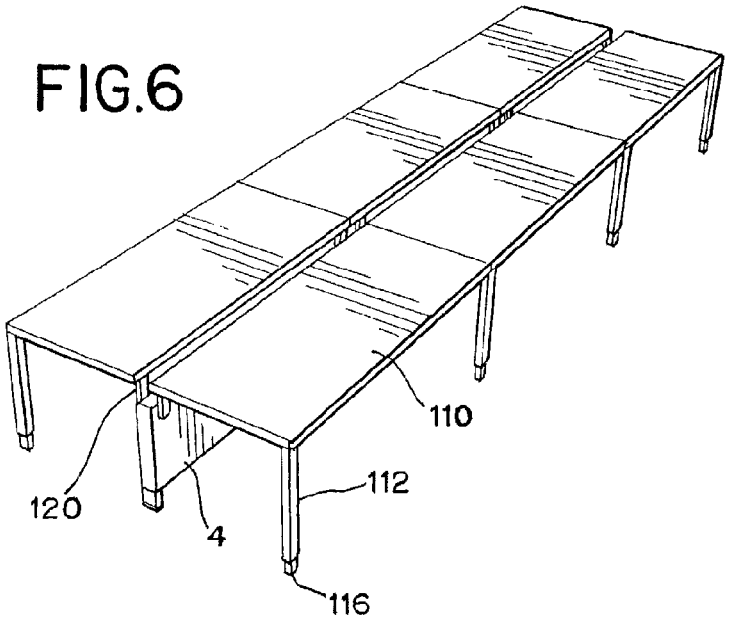
Figure 7:
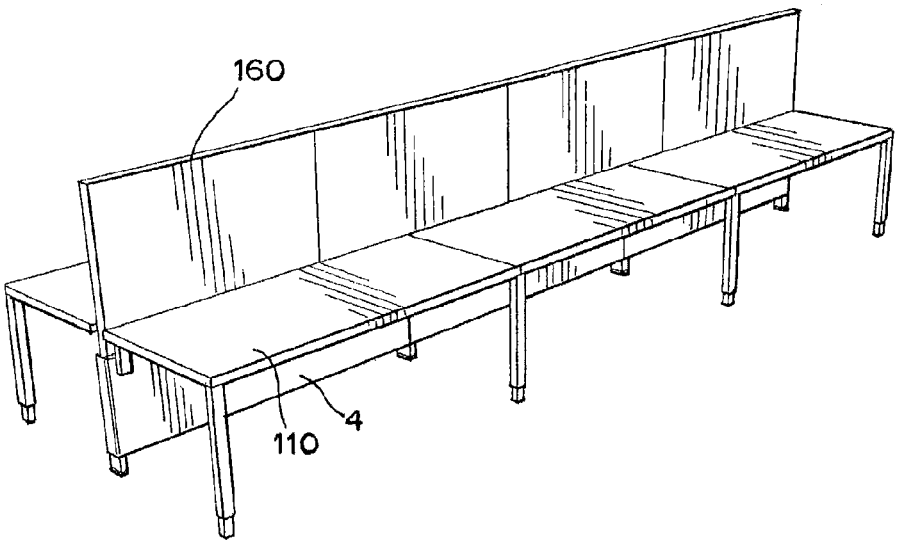
Figure 12:
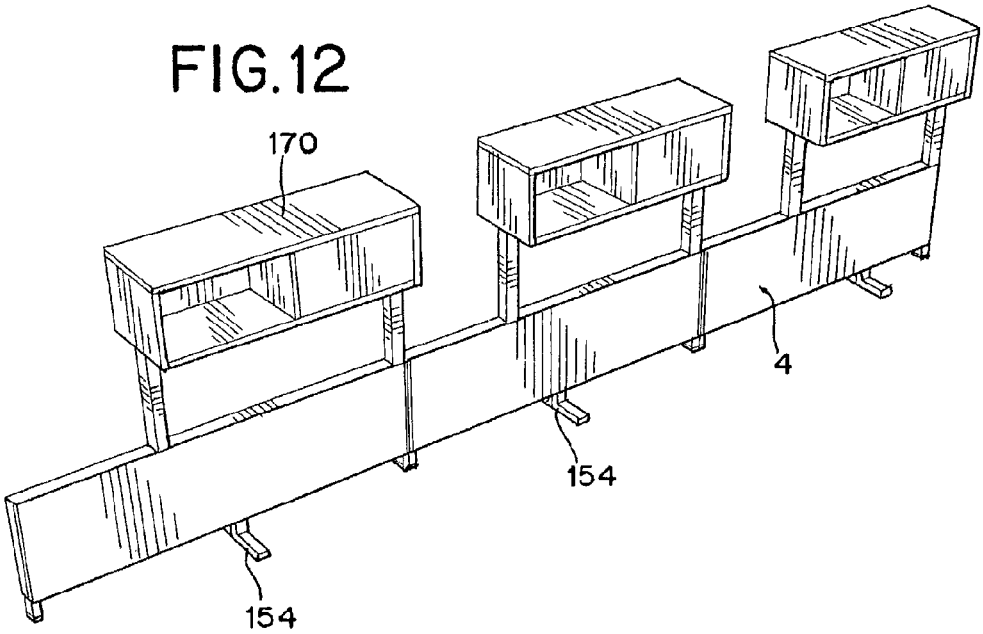
Figure 13:
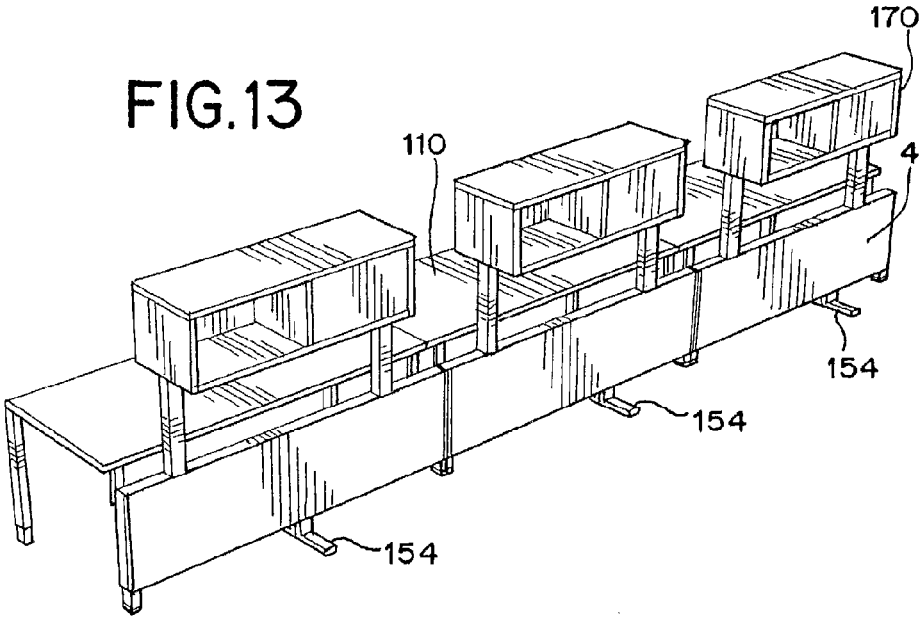
Figures 14, 15:
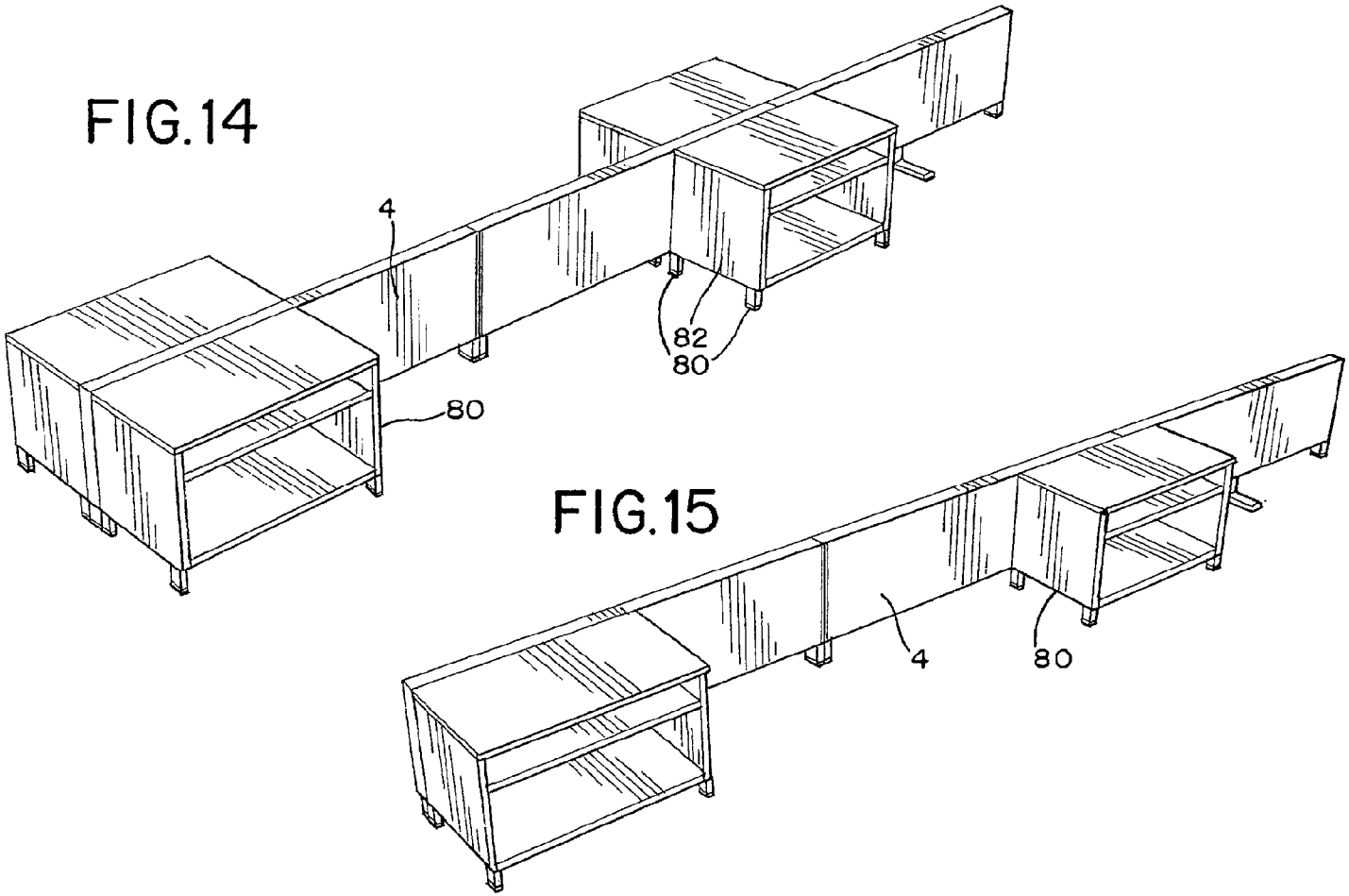
Figure 16:
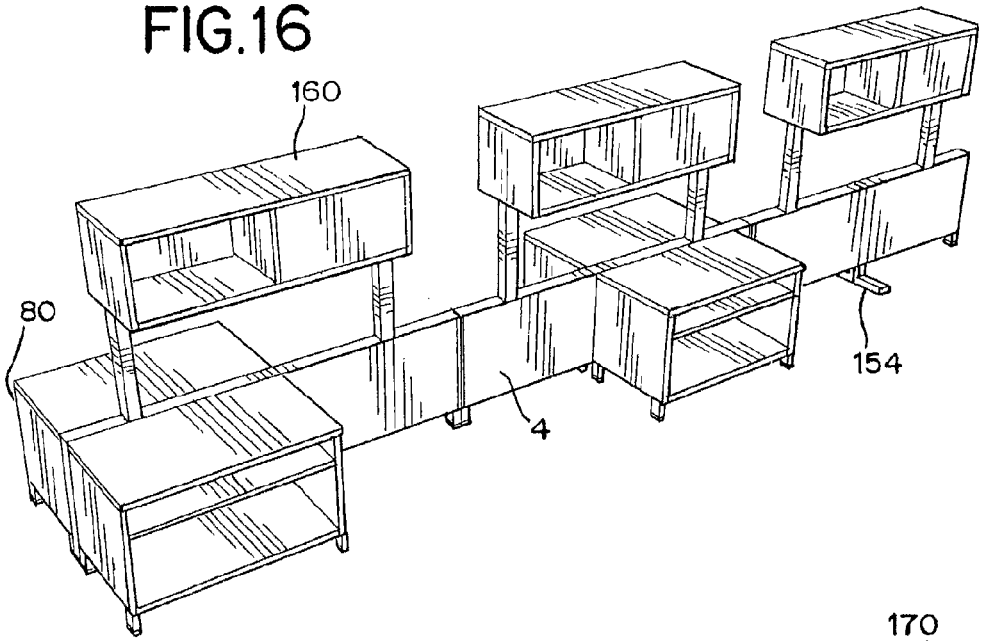
Figure 17:
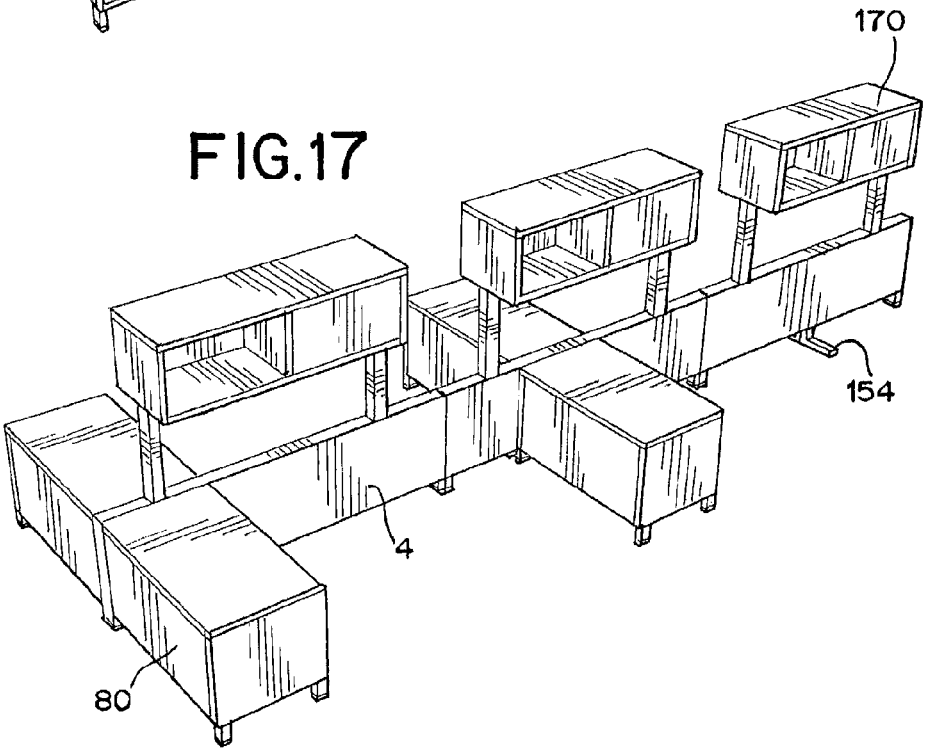
Figure 18:
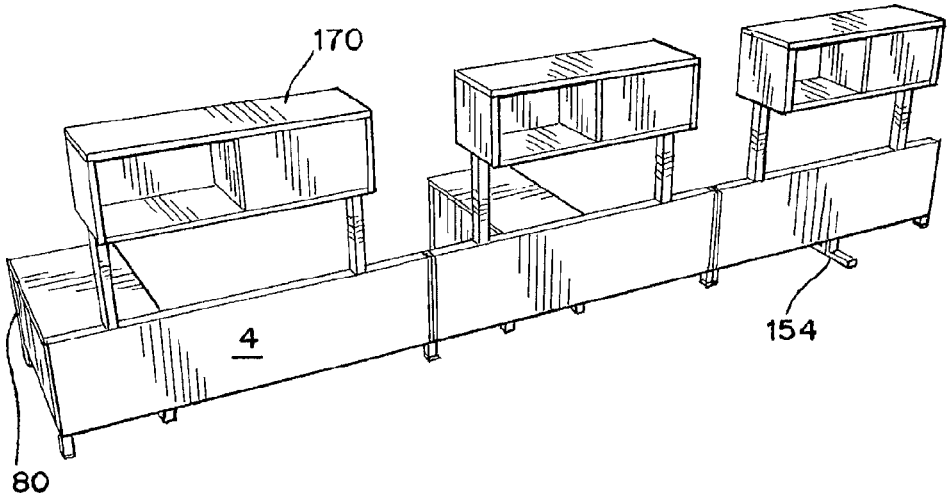
Figure 19:
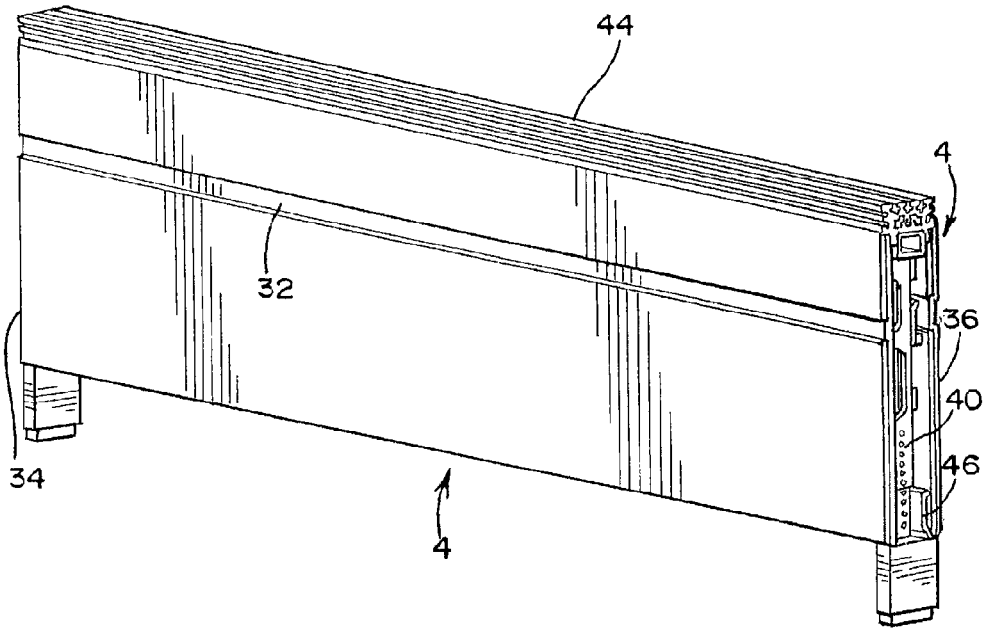
FIG. 19 is a perspective view of a dock.
Figure 22:
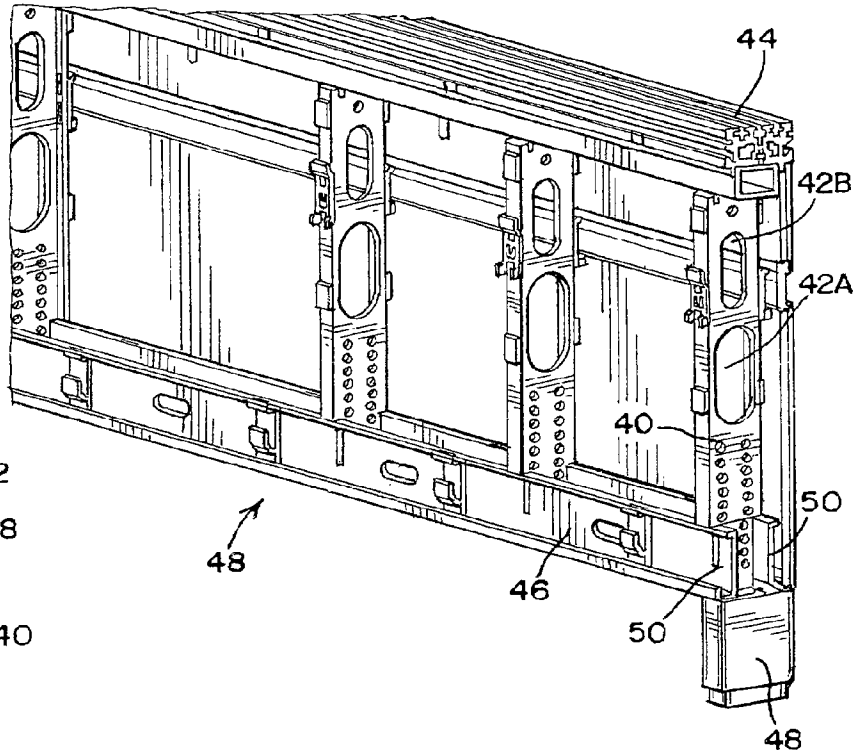
FIG. 22 is a partial perspective view of a dock with a side panel removed.
Figure 21:
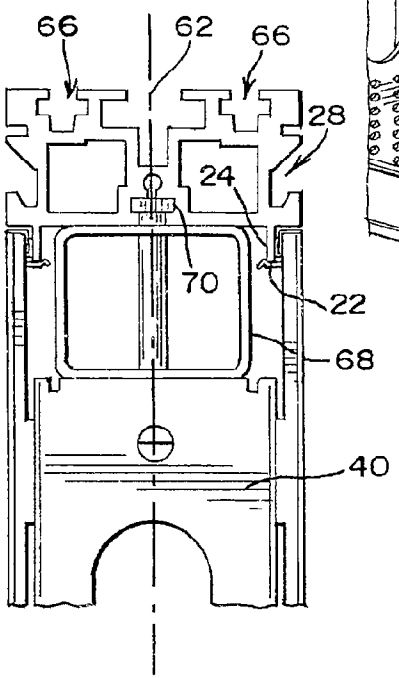
FIG. 21 is an enlarged end view taken along line 21-21 of FIG. 20 showing an upper rail.

To assemble a dock assembly, the user, such as a space planner, may provide a plurality of docks 4 arranged end-to-end. Depending on the desired configurations, the docks 4 may be supported by various dock supports, free standing or non-freestanding. For example, as shown in FIG. 3, the dock assembly may function as a simple barrier or partition, with a plurality of screens 160 mounted to the tops of the docks. In this embodiment, a plurality of T-shaped feet 154 may be secured to the docks 4. Referring to FIGS. 12 and 13, the spacing between feet may need to be decreased, when accessories, such as upper, high storage 170, is secured to the tops of the docks.

Figure 8:
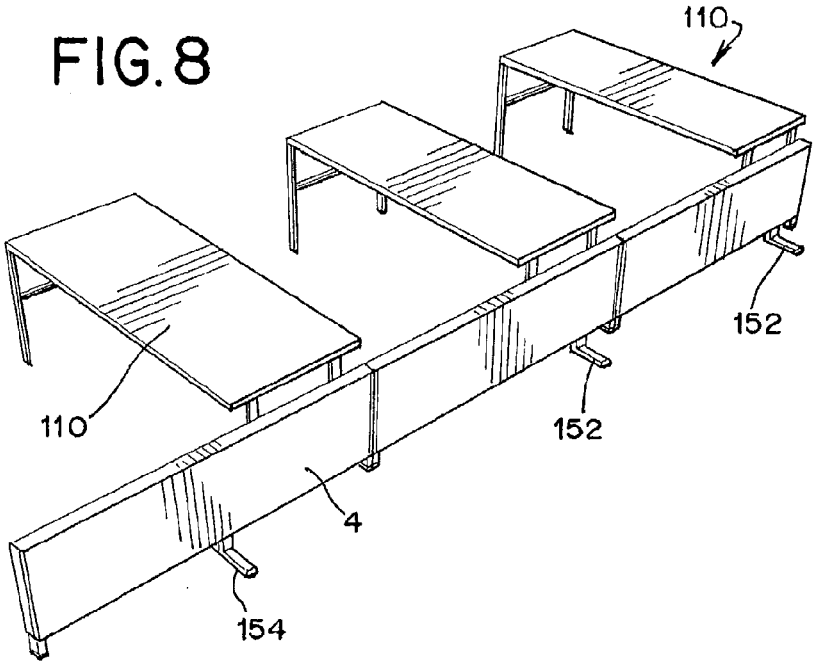
Figure 9:
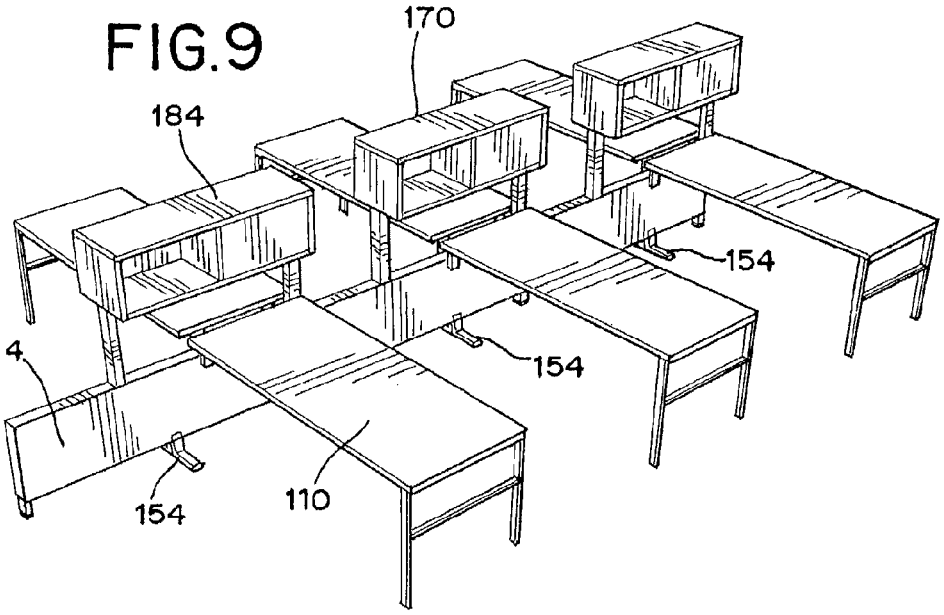
Figure 10:
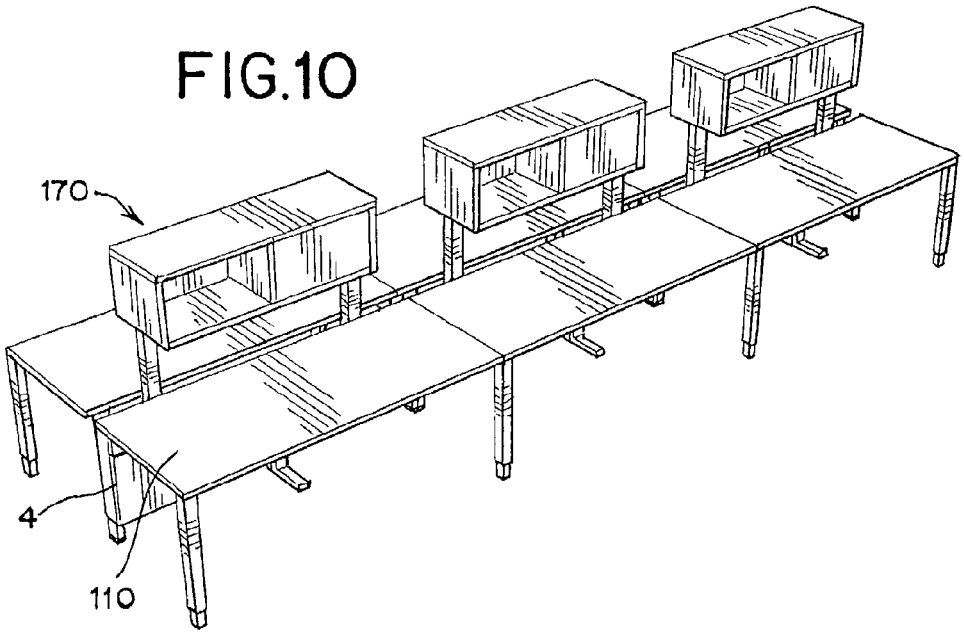
Figure 11:
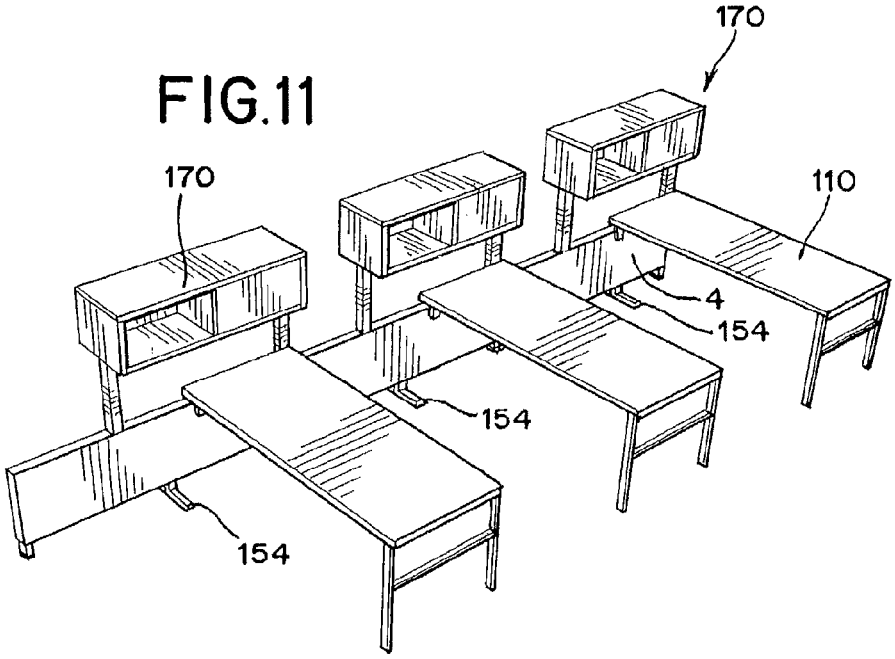
Figure 38:
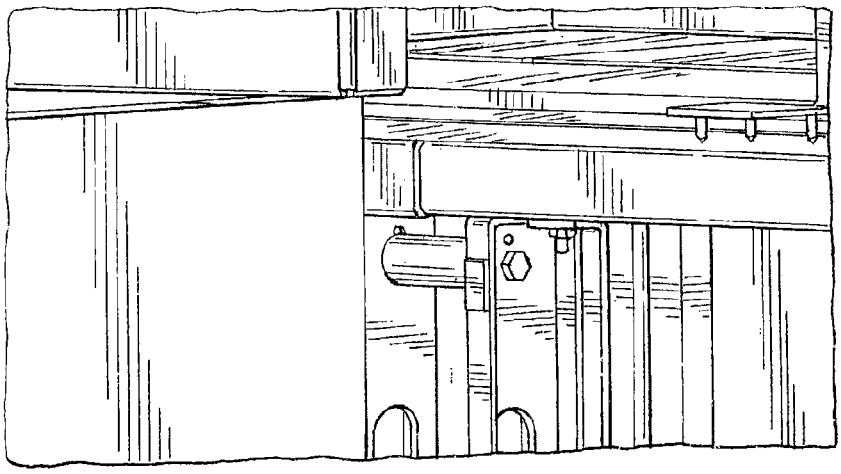
FIG. 38 shows a coupling between adjacent end-to-end docks.
Figure 39:
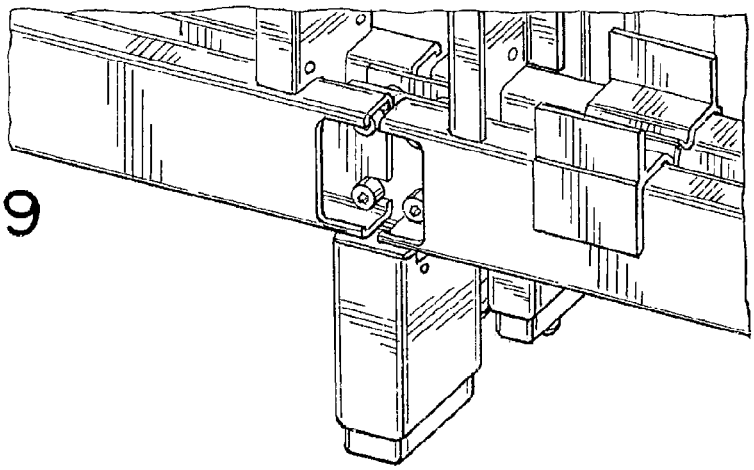
FIG. 39 shows a foot support joining the bottom of two adjacent end-to-end docks.
Figure 40:
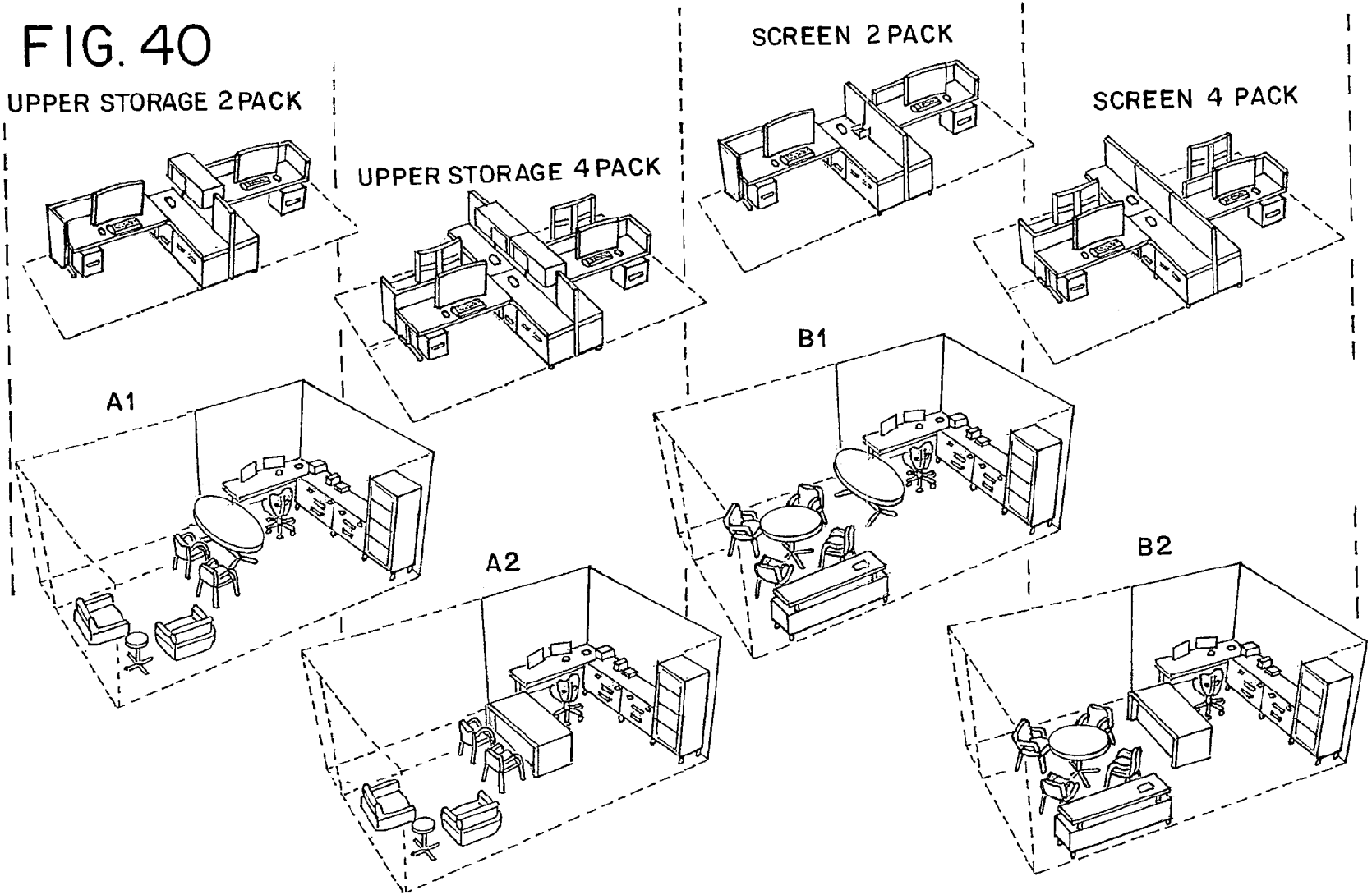
FIG. 40 shows various dock system embodiments.

Alternatively, as shown in FIGS. 4-7, a combination of support feet 150 and non-freestanding dock supports 110 may be coupled to a dock assembly. No support feet are needed where non-freestanding dock supports are connected to the dock. As shown in FIG. 8, an L-shaped foot 152 may be used where a non-freestanding dock support 110 is secured to only one side of a dock. In addition, as shown in FIGS. 9-11, support feet may also be used to further stabilize a dock assembly secured to non-freestanding dock supports, for example when additional stabilization is required by way of upper high storage 170 being secured to the docks. As shown in FIG. 28, a pair of pins 406 guide and couple adjacent docks. In addition, as shown in FIG. 38, a spacer may extend between end frame members of adjacent docks, with a bolt clamping the adjacent docks together. IN addition, and referring to FIG. 39, a foot is positioned at the junction between the two adjacent docks and is secured to the docks with plurality of bolts, thereby further coupling the adjacent docks.

Referring to FIGS. 14-18, freestanding dock supports 82 provide maximum support to the docks, even if located on only one side of the dock. In such an assembly, support feet may be omitted altogether.

Once the dock assembly is assembled, power and data may be routed through the docks 4, for example through the vertical frame openings, and into or out of the docks through the utility pass-through openings.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A furniture docking system comprising:

a plurality of docks each comprising opposite first and second sides and opposite first and second ends defining a length of each said dock, wherein said docks are arranged end-to-end along a longitudinal axis, each of said plurality of said docks comprising an upper rail and a lower rail and a plurality of vertical frame members extending between and connecting said upper and lower rails, said upper rail including an upwardly opening primary channel extending longitudinally along a top of said upper rail;

at least a first dock support and a second dock support each releasably connectable to each of said plurality of docks in a plurality of longitudinally spaced locations along said length of said dock and comprising a floor engaging portion laterally spaced from said dock, wherein said first dock support extends laterally from said dock on said first side thereof and said second dock support extends laterally from said dock on either of said first or second side thereof, wherein said first dock support is releasably coupled to said upper rail and lower rail, and said second dock support is coupled to at least one of said upper rail, said lower rail and/or one of said plurality of vertical frame members; and a furniture accessory coupled to said primary channel of said upper rail and extending upwardly from said upper rail;

wherein said primary channel extends along a centerline of said top of said upper rail, and wherein said upper rail further comprises a pair of upwardly opening auxiliary channels each extending continuously longitudinally along an entire length of a top of said upper rail on opposite sides of said primary channel.

2. The furniture docking system of claim 1 wherein said first dock support is coupled to said upper and lower rails with a draw rod.

3. The furniture docking system of claim 2 further comprising a pair of vertically spaced draw blocks engaging said first dock support and said upper and lower rails, wherein said draw rod extends between and is coupled to said draw blocks.

4. The furniture docking system of claim 1 wherein said second dock support is coupled to only said upper rail.

5. The furniture docking system of claim 4 wherein said second dock support comprises a support engaging one of said pair of auxiliary channels formed in said upper rail, a worksurface coupled to said support and at least one leg supporting said worksurface at a location laterally spaced from said dock, wherein said at least one leg comprises said floor engaging portion of said second dock support.

6. The furniture docking system of claim 5 wherein said worksurface is vertically adjustably coupled to said support.

7. The furniture docking system of claim 1 wherein said second dock support is coupled to one of said vertical frame members.

8. The furniture docking system of claim 7 wherein said second dock support comprises a support foot extending from said dock.

9. The furniture docking system of claim 8 wherein said support foot comprises a first support foot, and further comprising a second support foot coupled to said one of said vertical frame members opposite said first support foot and extending from said dock on said first side of said dock.

10. The furniture docking system of claim 1 wherein said furniture accessory engages said pair of auxiliary channels.

11. The furniture docking system of claim 1 wherein said second dock support engages one of said pair of auxiliary channels.

12. The furniture docking system of claim 1 wherein said upper rail further comprises a pair of side channels opening laterally outwardly from opposite sides of said upper rail, and wherein said first dock support engages one of said side channels.

13. The furniture docking system of claim 1 wherein said furniture accessory comprises overhead storage, said overhead storage comprising a stanchion engaging said primary channel.

14. A furniture docking system comprising:

a plurality of docks each comprising opposite first and second sides and opposite first and second ends defining a length of each said dock, wherein said docks are arranged end-to-end along a longitudinal axis, each of said plurality of said docks comprising an upper rail comprising an upwardly opening primary channel extending longitudinally along a centerline of a top of said upper rail, a pair of upwardly opening auxiliary channels extending longitudinally along a top of said upper rail on opposite sides of said primary channel, and a pair of side channels opening laterally outwardly from opposite sides of said upper rail;

at least a first dock support and a second dock support each releasably connectable to each of said plurality of docks in a plurality of longitudinally spaced locations along said length of said dock and comprising a floor engaging portion laterally spaced from said dock, wherein said first dock support extends laterally from said dock on said first side thereof and said second dock support extends laterally from said dock on said second side thereof, wherein said first dock support is coupled to said upper rail at one of said auxiliary channels, and said second dock support is coupled to said upper rail at one of said side channels; and a furniture accessory coupled to said primary channel of said upper rail and extending upwardly from said upper rail;

wherein said second dock support is coupled to said upper rail with a first draw block engaging said side channel, and further comprising a draw rod coupled between said first draw block and a lower rail vertically spaced from said upper rail, and a second draw block engaging said lower rail and coupled to said draw rod.

15. The furniture docking system of claim 14 wherein said first dock support comprises a support engaging said auxiliary channel, a worksurface coupled to said support and at least one leg supporting said worksurface at a location laterally spaced from said dock, wherein said at least one leg comprises said floor engaging portion of said first dock support.

16. The furniture docking system of claim 15 wherein said worksurface is vertically adjustably coupled to said support.

17. The furniture docking system of claim 14 wherein each of said docks further comprises a lower rail vertically spaced from said upper rail and a plurality of vertical frame members extending between and connected to said upper and lower rails, and further comprising a third dock support coupled to one of said vertical frame members of another one of said docks.

18. The furniture docking system of claim 17 wherein said third dock support comprises a support foot extending laterally from said another one of said docks.

19. The furniture docking system of claim 18 wherein said support foot comprises a first support foot, and further comprising a second support foot coupled to said one of said vertical frame members opposite said first support foot and extending from another of said docks opposite said first support foot.

20. The furniture docking system of claim 14 wherein said furniture accessory further engages said pair of auxiliary channels.

21. The furniture docking system of claim 14 wherein said furniture accessory comprises overhead storage, said overhead storage comprising a stanchion engaging said primary channel.

* * * * *